US006205972B1

(12) United States Patent
Di Stefano

(10) Patent No.: US 6,205,972 B1
(45) Date of Patent: Mar. 27, 2001

(54) ENGINE

(75) Inventor: Alfonso Di Stefano, Grosse Pointe Park, MI (US)

(73) Assignee: Cypress Semiconductor Corp., San Jose, CA (US)

( * ) Notice: Subject to any disclaimer, the term of this patent is extended or adjusted under 35 U.S.C. 154(b) by 0 days.

(21) Appl. No.: 09/299,836

(22) Filed: Apr. 26, 1999

Related U.S. Application Data

(60) Provisional application No. 60/094,393, filed on Jul. 28, 1998.

(51) Int. Cl.[7] ..... F02B 75/32

(52) U.S. Cl. ..... 123/197.1; 123/197.4; 123/52.1

(58) Field of Search ..... 123/197.1, 197.4, 123/52.1, 52.3, 52.5

(56) References Cited

U.S. PATENT DOCUMENTS

| | | | | |
|---|---|---|---|---|
| 1,165,400 | * | 12/1915 | Dreisbach | 123/52.1 |
| 1,172,976 | * | 2/1916 | Frederickson | 123/52.1 |
| 2,097,742 | | 11/1937 | Scott | 123/51 AA |
| 2,130,529 | * | 9/1938 | Filicky | 123/197.1 |
| 2,137,941 | | 11/1938 | Helmore et al. | 123/52.3 |
| 3,537,437 | | 11/1970 | Paul et al. | 123/52.4 |
| 3,805,752 | | 4/1974 | Cataldo | 123/52.4 |
| 4,079,705 | | 3/1978 | Buchner | 123/53 B |
| 4,170,970 | | 10/1979 | McCandless | 123/53 BA |
| 4,213,427 | | 7/1980 | Di Stefano | 123/43 AA |
| 4,308,002 | | 12/1981 | Di Stefano | 418/15 |
| 4,690,113 | * | 9/1987 | Deland | 123/53.2 |
| 4,964,379 | | 10/1990 | August | 123/51 B |
| 4,964,380 | | 10/1990 | Kusche | 123/73 V |
| 5,535,715 | * | 7/1996 | Mouton | 123/197.1 |
| 5,732,668 | | 3/1998 | Di Stefano | 123/52.4 |
| 5,983,845 | * | 11/1999 | Yanagisawa | 123/197.1 |

* cited by examiner

*Primary Examiner*—John Kwon
(74) *Attorney, Agent, or Firm*—Christopher P. Maiorana, P.C.

(57) ABSTRACT

An internal combustion engine comprising an engine block having two opposed guide slots on an interior surface. The guide slots may be parallel to the direction of movement of the engine pistons. At least one pair of cylinders may be formed in the engine block. The pistons may each be moving in a linear direction perpendicular to the inside of a respective one of the cylinders in response to energy forces in a respective chamber positioned at one end of each cylinder.

14 Claims, 7 Drawing Sheets

ENGINE

CROSS REFERENCE TO RELATED APPLICATIONS

The present application claims the benefit of provisional application Ser. No. 60/094,393, filed Jul. 28, 1998, which is hereby incorporated by reference in its entirety.

FIELD OF THE INVENTION

The present invention relates to an engine generally and, more particularly, to a displacement engine using reciprocating pistons coupled to at least one crankshaft.

BACKGROUND OF THE INVENTION

Internal combustion engines are used in a wide variety of applications relating to transportation, generation of electricity and other industrial applications. A chamber is generally filled with a combustible gas which is ignited causing a piston to move inside a cylinder in a direction outward from the direction of the ignition.

A connecting rod is generally used to transfer the energy from the piston to a crankshaft. The crankshaft is then used to perform work such as turning an electrical generator or driving the wheels of an automobile. As the crankshaft turns, the piston oscillates between two positions. As a result, the connecting rods generally move from side to side about the rotation of the driveshaft. This side to side motion causes stresses in the cylinder, the piston and between the piston rings and the cylinder wall.

To compensate for these stresses, previous approaches have extended the height of the piston in order to provide greater surface area contact between the piston and the cylinder wall. As a result, the side to side forces are reduced, but at the expense of greater friction and additional wear upon the piston rings.

Certain previous approach engines, such as U.S. Pat. No. 5,435,232, have shown a single piston connected to two or more connecting rods. However, such an arrangement does not provide the benefits of the present invention, such as reducing the side to side forces, reducing friction and reducing additional wear upon the piston rings. Other such previous approaches are generally limited to a single piston driving one or more connecting rods.

SUMMARY OF THE INVENTION

The present invention concerns an internal combustion engine comprising an engine block having two opposed guide slots on an interior surface. The guide slots are typically parallel to the direction of movement of the engine pistons. At least one pair of cylinders may be formed in the engine block. The pistons may each be moving in a linear direction perpendicular to the inside of a respective one of the cylinder walls in response to energy forces in a respective chamber positioned at one end of each cylinder. A stabilizer (which may be formed as a single piece with the pistons) may have a main body portion. The main body portion may have two main body ends, connected to a lower portion of each piston, a guide rod portion having first and second guide rod ends, where each of the guide rod ends engages one of the guide slots in the housing, and a pair of gears. A respective one of the pair of gears may be connected to each end of the stabilizer and may be configured to engage each other. The guide rod portion and the gears maintain the linear direction of movement of said pistons. At least one pair of connecting arms may each be pivotally connected to a respective one of the first and second ends of the stabilizer. A first crankshaft may be connected to a first connecting arm of the pair of connecting arms. A second crankshaft may be connected to a second connecting arm of the pair of connecting arms. The first and second crankshafts transfer energy to one or more external devices.

Objects, features and advantages of the present invention include providing an internal combustion engine that may (i) reduce the wear on the piston rings, (ii) reduce the amount of area of a piston ring that needs to be in contact with the cylinder wall, (iii) provide a generally linear motion of the pistons in a direction parallel to the cylinder walls, (iv) drive two or more independently rotating crankshafts, (v) reduce the overall size of the engine, and/or (vi) increase the overall efficiency of the engine, improve the overall performance of the engine, and allow the engine to operate cleanly.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 1:
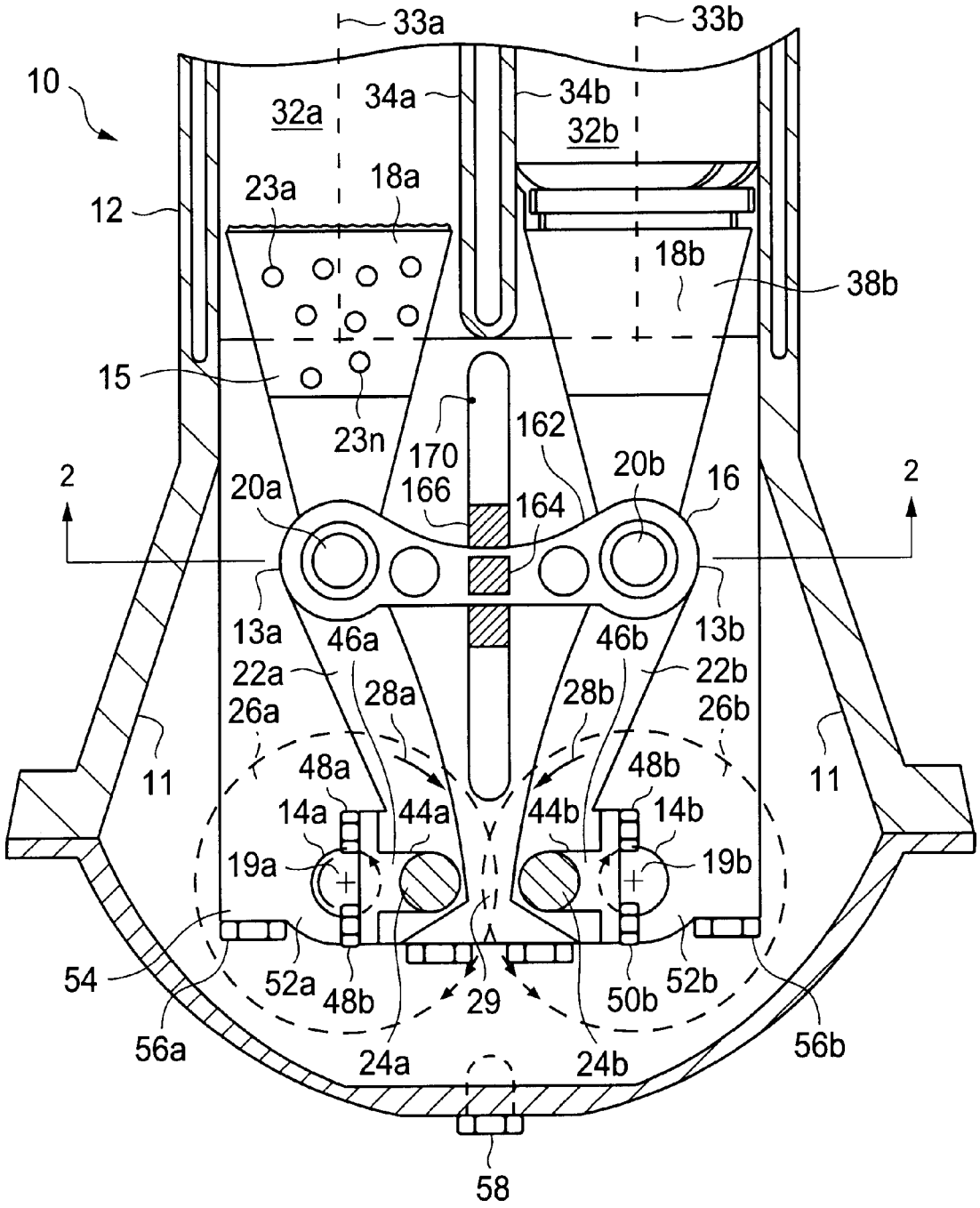
FIG. 1 is a side view of a preferred embodiment of the present invention.

Referring to FIG. 1, an engine 10 is shown in accordance with a preferred embodiment of the present invention. The engine 10 comprises a housing 12 with an interior surface 11, a first crankshaft 14*a*, a second crankshaft 14*b*, and at least one piston assembly 15. The piston assembly 15 has at least one piston 18*a* and a stabilizer 16. The piston assembly 15 shown illustrates an example having two pistons (e.g., 18*a* and 18*b*). The stabilizer 16 is typically elongated having a first end 13*a* and a second end 13*b*. Rigidly projecting through end 13*a* is a pivot 20*a* and projecting through end 13*b* is a pivot 20*b*. A pair of pivoting connecting arms 22*a* and 22*b* are pivotally connected between the pivots 20*a* and 20*b* and the crankshafts 14*a* and 14*b*, respectively. The pivoting connecting arms 22*a* and 22*b* generally correspond to a conventional connecting rod. While the crankshafts 14*a* and 14*b* may be pivotally connected to the stabilizer 16, the pistons 18*a* and 18*b* are generally rigidly connected to the stabilizer 16. In one example, the pistons 18*a* and 18*b* may be fabricated as a single piece with the stabilizer 16.

The crankshafts 14*a* and 14*b* have substantially parallel rotational axis 19*a* and 19*b*, and at least one set of lobes 24*a* and 24*b* corresponding to at least one piston assembly 15. The lobes 24*a* and 24*b* may be an integral part of the crankshafts 14*a* and 14*b*, and may be positioned at a prescribed distance away from rotational axis 19*a* and 19*b* to create moments which force the crankshafts 14*a* and 14*b* to turn in counter directions 28*a* and 28*b*. The connecting arms 22*a* and 22*b* are pivotally connected to the lobes 24*a* and 24*b* respectively.

The pistons 18*a* and 18*b* travel inside cylinders 32*a* and 32*b*, respectively. The cylinders 32*a* and 32*b* are defined by cylinder walls 34*a* and 34*b* concentrically located about longitudinal centerlines 33*a* and 33*b*. The pistons 18*a* and 18*b* reciprocate along the longitudinal centerlines 33*a* and 33*b*. The centerlines 33*a* and 33*b* are generally parallel to each other. The piston 18 generally comprises a portion 36, a piston ring 42 and a portion 38. In a combustion gas engine application, the portion 36 generally receives the physical force from the ignition of the combustible gas and transfers the physical force to the portion 38. The portion 38 is shown to be in a generally conical configuration with the smaller of two ends being rigidly attached to the stabilizer 16. The conical configuration is illustrated to show a high strength implementation of the portion 38.

The piston ring (or seal) 42 provides a seal between the piston 18 and the cylinder wall 34. Since the overall motion of the piston 18 is generally linear in a direction parallel to the cylinder wall 34, the stresses placed on the ring 42 are minimized. Reducing stress is particularly important in the application of compressor engines. While combustion engine technology may minimize some stress by the use of oil, compressor technology is generally restricted in the use of oil since contamination of the compressed gas could result. Therefore, reducing stress by the use of oil lubricants for compressors is an undesirable option, making the benefits of the present invention promising for compressors. In addition, since the present invention reduces stress, lower cost materials may be used to implement the ring 42 without sacrificing performance of the overall design. A lower cost ring 42 improves the overall production efficiency of implementing the engine 10. The seal 42 may eliminate crevasses between the piston 18 and the cylinder wall, which may reduce pollution and decrease the negative impact on the environment.

A cylinder head (not shown) is generally required to be mounted on top of the cylinder wall 34*a* and the cylinder wall 34*b*. The cylinder head generally encompasses each of the cylinders 32 and provides a chamber at the top of the cylinder for the ignition of the combustible gas. A cylinder head that creates either a single combustion chamber for both the cylinders 32*a* and 32*b* or a separate combustion chamber for each of the cylinders 32*a* and 32*b* may be implemented accordingly to meet the design criteria of a particular application. An example of a single combustion chamber operating two independent pistons is shown in U.S. Pat. No. 4,964,379 which is hereby incorporated by reference. The same cylinder head placement may be applied to reciprocating pump or compressor applications.

The pivoting connecting arms 22*a* and 22*b* are connected to the lobes 24*a* and 24*b* by creating an opening 44*a* and 44*b*. The connecting point 24*b* is generally inserted into the opening 44*a* and may be secured by a portion 46*a*. The portion 46*a* is generally secured by a pair of bolts 48*a* and 48*b*. However, other fastening means may be substituted for the bolts 48*a* and 48*b* accordingly to meet the design criteria of a particular application. Similarly, the portion 46*b* is generally secured by a pair of bolts 50*a* and 50*b*. The crankshafts 14*a* and 14*b* are secured in place by a portion 52*a* and 52*b*. The portions 52*a* and 52*b* are secured to portion 54 by a pair of bolts 56*a* and 56*b*. An oil plug 58 is shown which may be removed to change the lubrication used in the engine 10.

The crankshafts 14*a* and 14*b* have a rotational axis 19*a* and 19*b* around geared disk sets 26*a* and 26*b*, respectively. Geared disk sets 26*a* and 26*b* are formed from, or rigidly secured to, crankshafts 14*a* and 14*b*, and are generally concentrically located about the rotational axis 19*a* and 19*b*. The geared disk sets 26*a* and 26*b* each comprise a geared disk set pair, identified as geared disks 26*a*1, 26*a*2, 26*b*1, and 26*b*2. Each geared disk, of each respective pair may be rigidly secured to either end of respective lobes 24*a* and 24*b*. The geared disk sets 26*a* and 26*b* may be interlocked at a portion 29, thereby, engaging crankshaft 14*a* to crankshaft 14*b*. The disk set 26*a* rotates about the rotational axis 19*a* in a direction generally indicated by the arrow 28*a*. Similarly, the disk set 26*b* rotates in a counter direction about the rotational axis 19*b* in a direction indicated generally by the arrow 28*b*. The lobe 24*a* revolves about the rotational axis 19*a* at the same approximate angular velocity and distance as the lobe 24*b* revolves about the rotational axis 19*b*. As a result, the forces received from the stabilizer 16 are generally balanced about the rotation of the crankshafts 14*a* and 14*b*. This balancing, assured by the engagement of crankshafts 14*a* and 14*b*, reduces the overall vibration of the engine 10. As a result of the reduced vibration, less overall stress is placed on the engine 10 resulting in a longer useful life. The stabilizer 16 also connects (e.g., using a single piece construction) to the pistons 18*a* and 18*b* and forces the pistons to move in a generally linear direction.

Figure 2:
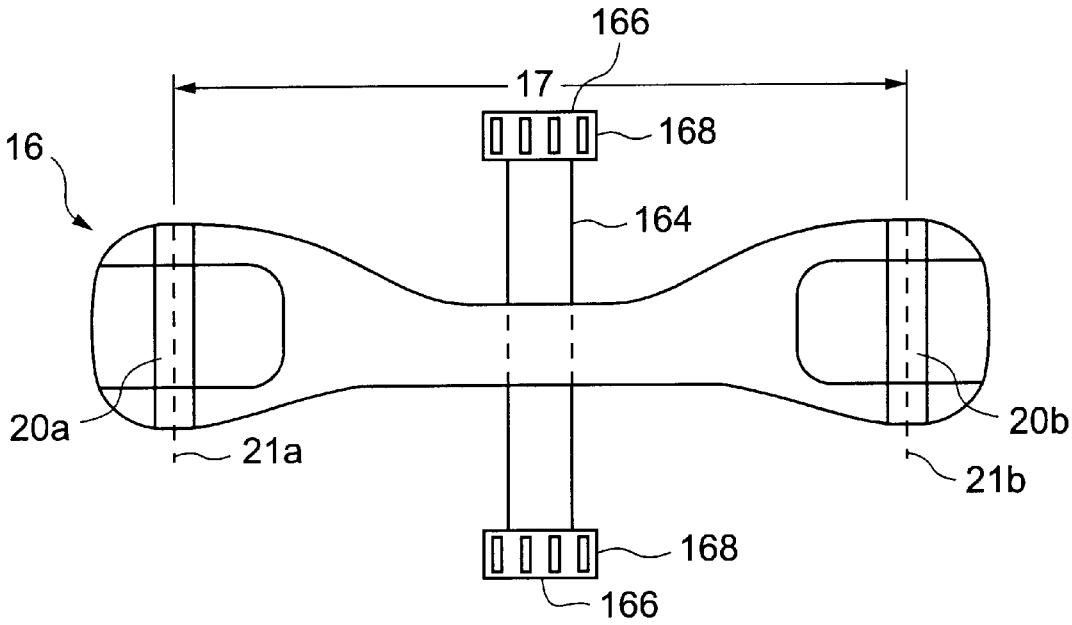
FIG. 2 is a plane view of the piston assembly of FIG. 1.

Referring to FIG. 2, a more detailed diagram of one example of the stabilizer 16 is shown. The stabilizer 16 further comprises a longitudinal span 17 which may extend from the pivot 20*a* to the pivot 20*b*. The pivot 20*a* and pivot 20*b* may have an axis 21*a* and 21*b*, which are substantially parallel to one another, and generally perpendicular to longitudinal span 17. The longitudinal centerlines 33*a* and 33*b* are spaced at an equal distance from the midpoint of longitudinal span 17. In addition, longitudinal centerlines 33*a* and 33*b* are substantially perpendicular to the axis 21*a* and 21*b*. Such positioning reduces vibration of the engine 10 and may improve efficiency by providing equal and identical vector forces exerted upon pivots 20*a* and 20*b*.

It will be noted from the drawings that the present invention does not have gears connected to pivots 20*a* and 20*b*, as was the case in the invention of U.S. Pat. No. 5,732,668. In the present invention, those gears are replaced by the modified stabilizer 16. The stabilizer 16 still serves to rigidly connect to the pistons 18*a* and 18*b*, but the stabilizer 16 now also has a guide rod portion 164. The guide rod portion 164 is generally orientated at mid-point (and perpendicular) to the longitudinal span 17. The portion 164 is further substantially perpendicular to longitudinal centerlines 33*a* and 33*b* and is configured to extend to opposing sides of the interior surface 11 of the engine housing 12. While the preferred embodiment of the present invention does not include the gears connected to pivots 20*a* and 20*b*, in order to minimize the number of parts, it will be appreciated by one of skill in the art that such pivot gears may be used in conjunction with the present stabilizing mechanism, if desired in a specific application.

The extending guide rod portion 164 has both a first guide rod end 166*a* and a second guide rod end 166*b*, each provided with a guide rod end bearing 168. The guide rod ends 166*a* and 166*b* each engage one of opposing guide slots 170 formed or engraved into opposing interior surfaces 11 of the housing 12 of the engine 10. The guide slots 170 are parallel to one-another and substantially parallel to longitudinal centerlines 33*a* and 33*b*. The guide slots 170 generally have sufficient length (approximately the length of travel of the piston 18) so that connecting rod 22 has a free and unhindered revolutionary movement about rotational axis 19. If considered desirable in certain applications to enhance stability, the guide rod ends 166 may be of greater height in the direction parallel to the longitudinal centerline 33 than the cross sectional height of guide rod portion 164. While FIG. 1 shows an example of ends 166 with greater height than portion 164, FIG. 2. shows an example of these elements having the same length. In either case, the guide rod portion 164 may serve to force the pistons 18 to move in a generally linear direction parallel to the longitudinal centerline 33 of the cylinder 32, thus aiding in the reduction of vibration, resulting in extending the useful life of engine 10.

In FIG. 2, a bottom view of guide rod portion 164 of stabilizer 16 is shown. Each of the ends 166*a* and 166*b* are shown having a guide rod end bearing 168 which may facilitate movement of guide rod portion 164 in the guide slots 170. If desired, the guide slots 170 may also be provided with a bearing surface for the same purpose. In one embodiment of the invention, the piston assembly 15, including the pistons 18, the stabilizer 16, and the guide rod portion 164, may be formed as a unitary piece to provide for the greatest strength.

Two features may be incorporated to reduce the weight of the components, thus providing a low cost implementation while still maintaining high strength and efficiency. The connecting arm 22 may be formed with an arcuate taper to reduce the amount of material used to form it. Similarly, the portion 38 of the piston 18 may be formed with a pattern of swiss cheese like holes 23*a*–23*n* to eliminate the amount of material to reduce weight, while still maintaining sufficient strength. The placement of the holes 23*a*–23*n* may be modified so long as adequate strength of the resulting piece is maintained.

Figure 3:
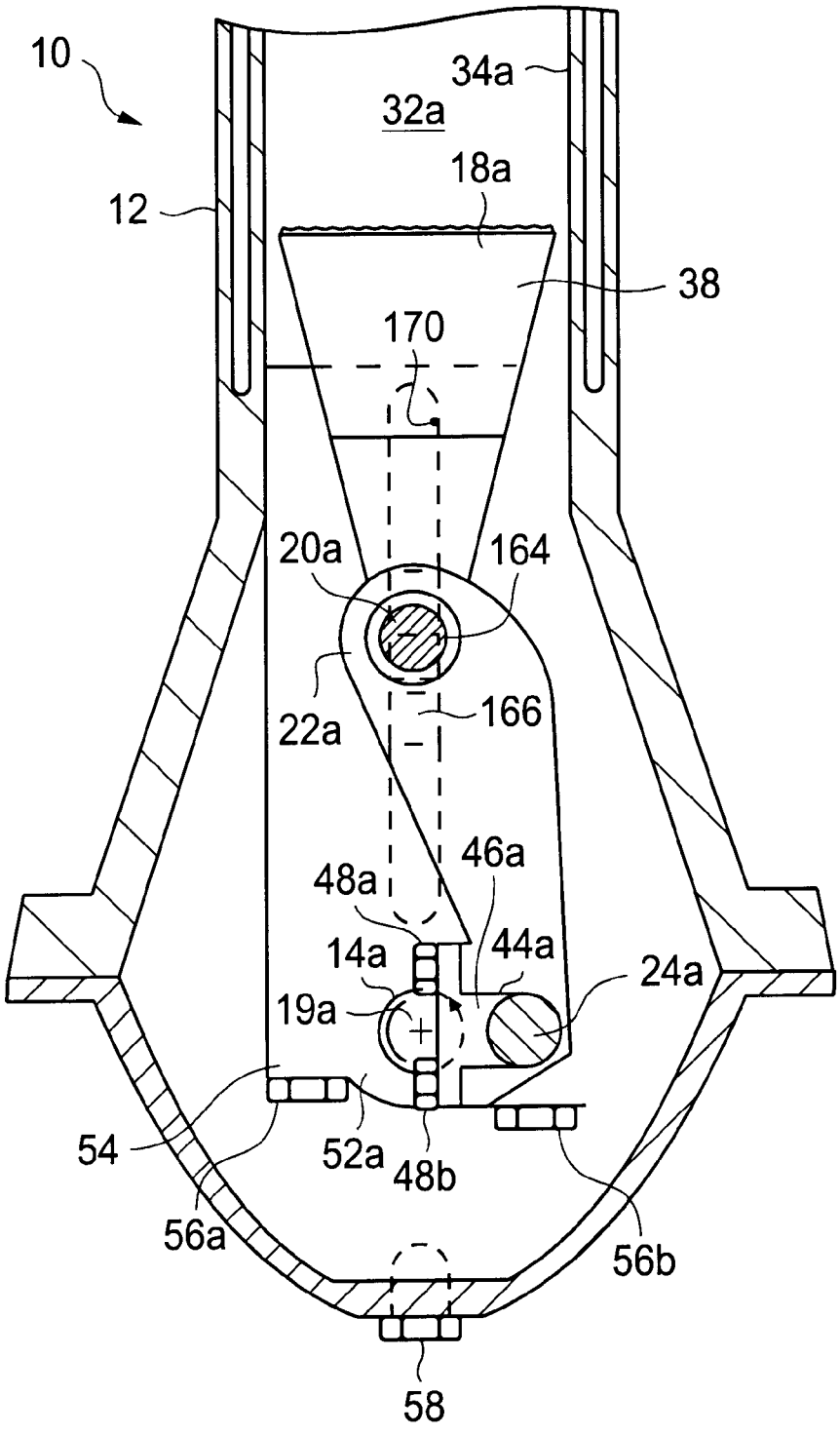
FIG. 3 is an alternate cross section of the engine of FIG. 1.

Referring to FIG. 3, in an alternative embodiment, the piston assembly 15 is omitted and replaced with a single piston 18*a* where the guide rod portion 164 is rigidly connected to the end of piston 18*a* and pivotally connected to connecting arm 22*a*. The connecting arm 22*b* is not shown since this embodiment entails only a single crankshaft 14*a*. The portion 164 can be formed as part, preferably as a unitary part, of the pivot 20. There is not generally a requirement that the guide rod portion 164 has specific cross-sectional shape so long as adequate strength is provided. In such an arrangement, there is no need for the stabilizer 16 since there would be no second piston 18*b* to be connected with the first piston 18*a*. In such a single piston 18 embodiment, the opposed guide slots 170 in housing 12 would be appropriately positioned, generally midline, below the cylinder 32*a* in which the piston 18*a* travels. Again, the guide rod portion 164, with guide rod ends 166 engaged within guide slots 170, will facilitate the generally linear movement of the piston 18*a* in the cylinder 32*a*. The location of the guide rod portion 164 and corresponding alignment of guide slots 170 may be used in other than single piston arrangements.

Figure 4:
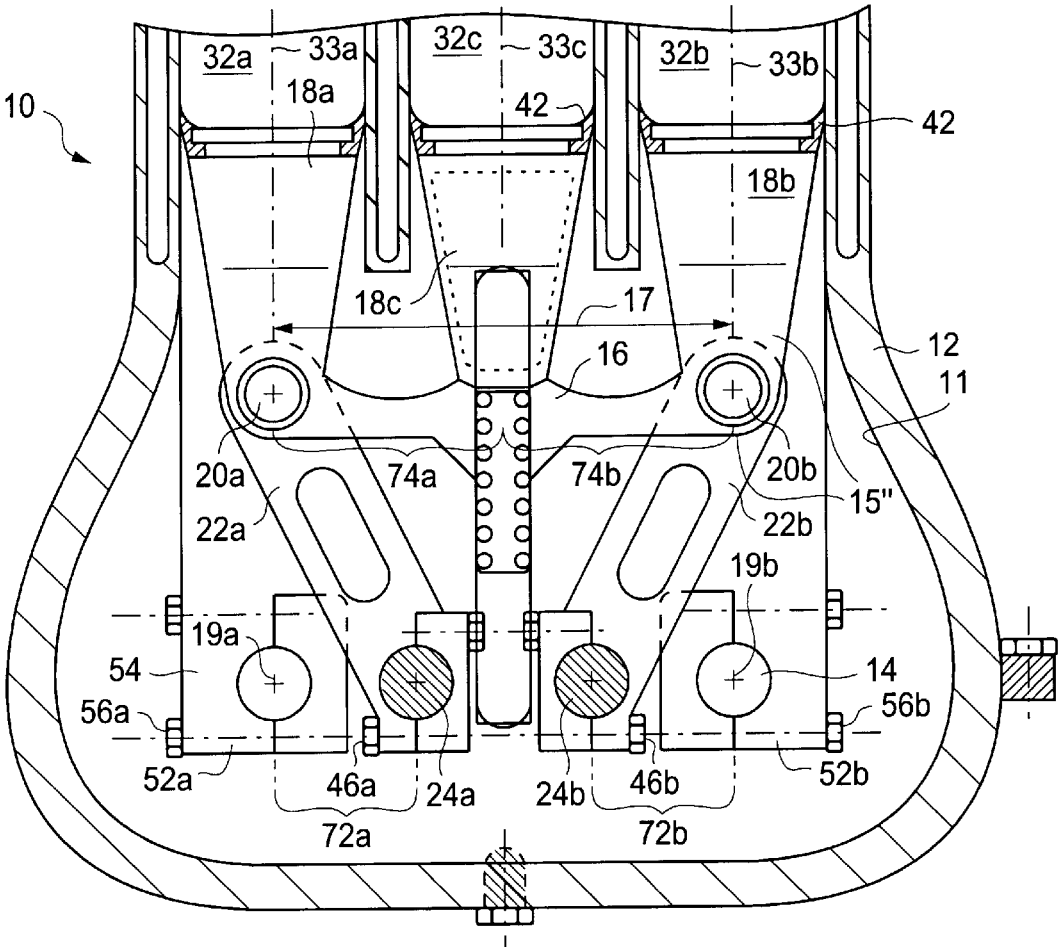
FIG. 4 is a cross sectional view of an alternate embodiment of the present invention.

Referring to FIG. 4, another alternative embodiment is shown. The piston assembly 15" remains, but unlike FIG. 1, a three piston (e.g., 18*a*, 18*b* and 18*c*) application is shown. The piston 18*c* does not have the associated pivots 20*a* and 20*b* of pistons 18*a* and 18*b*, but does have a connection point 70, where the piston 18*c* attaches to the stabilizer 16. So as not to create unbalanced forces between the pivots 20*a* and 20*b*, the connection point 70 and the guide rod portion 164 are connected to stabilizer 16 substantially at mid-point of the longitudinal span 17. The longitudinal span 17 is thereby bisected into span 74*a*, defined by the pivot 20*a* and the connection point 70, and span 74*b*, defined by the connection point 70 and the pivot 20*b*. Like pistons 18*a* and 18*b*, piston 18*c* has a longitudinal axis 33*c*, where the longitudinal axis 33*a*, 33*b*, and 33*c* are parallel and positioned within the same plane, thereby minimizing wear on the piston rings 42.

Figure 5:
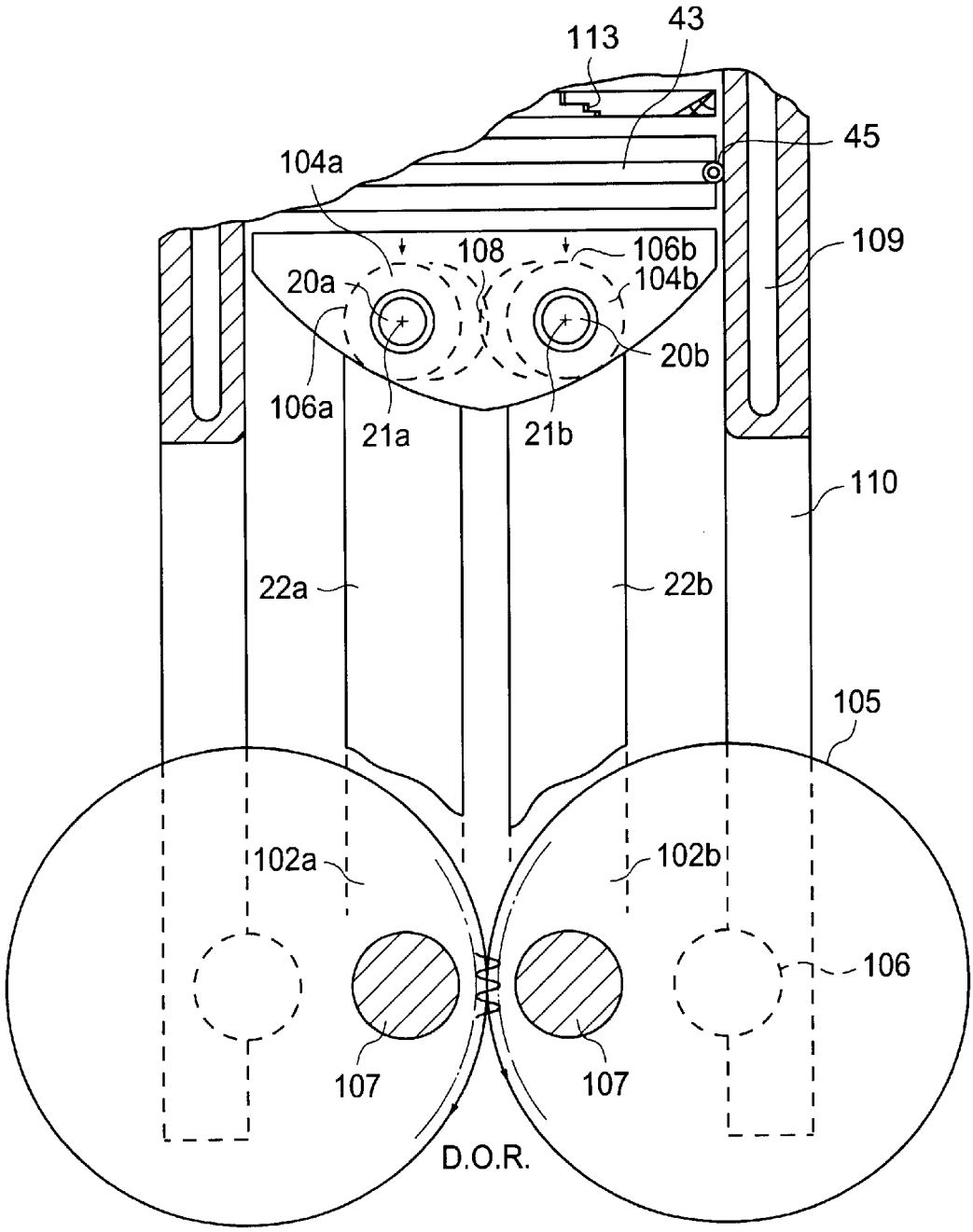
FIG. 5 is another alternate embodiment of the present invention.

Referring to FIG. 5, an alternate embodiment of FIG. 1 is shown where the guide rod portion 164 and the stabilizer 16 are eliminated. The connecting arms 22*a* and 22*b* further have a first end 102*a* and 102*b* which pivotally attach to the lobes 24*a* and 24*b*, and second ends 104*a* and 104*b* which both pivotally connect to piston portion 40' at the pivots 20*a* and 20*b*. The second ends 104*a* and 104*b* pivot about axis 21*a* and 21*b*. The second ends 104*a* and 104*b* further each have a geared circumference 106*a* and 106*b* which engage one another at portion 108. The geared circumference 106*a* and 106*b*, along with piston portion 40', provide a guiding effect to force the piston to move in a generally linear direction. The geared circumference 106*a* and 106*b* may be a bevel gear, a standard gear, a worm gear or any other type of gear required to meet the design criteria of a particular application. This gear design is an improvement over referenced U.S. Pat. No. 5,732,668 because it utilizes less parts and less weight in order to achieve a similar gear concept.

Figure 6:
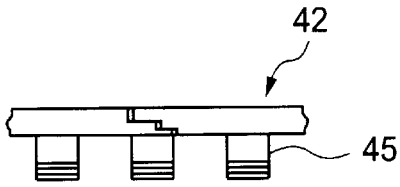
FIG. 6 illustrates an example of rings that may be used with the present invention.

Referring to FIG. 6, a cross section of the piston ring 42 is shown. The ring 42 generally has a stepped interlacing portion 45 which snaps into groove 43 of piston 18.

Figure 7:
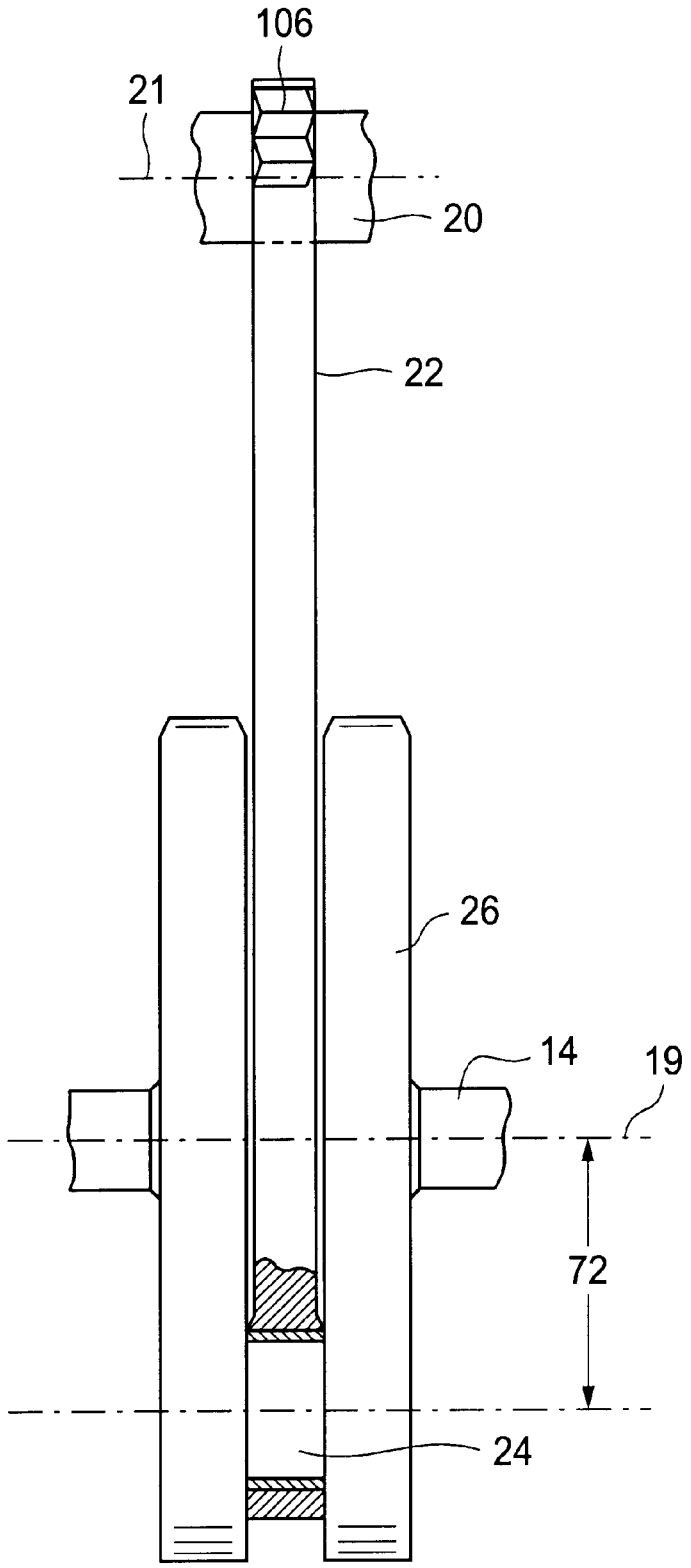
FIG. 7 illustrates a side view of the engine of FIG. 6.

Referring to FIG. 7, a more detailed alternate side view of the engine 10 of FIG. 5 is shown with the piston 18 at the bottom. FIG. 7 further shows the axis 21 of the pivot 20 with a plan view of the geared circumference 106.

Figure 8A:
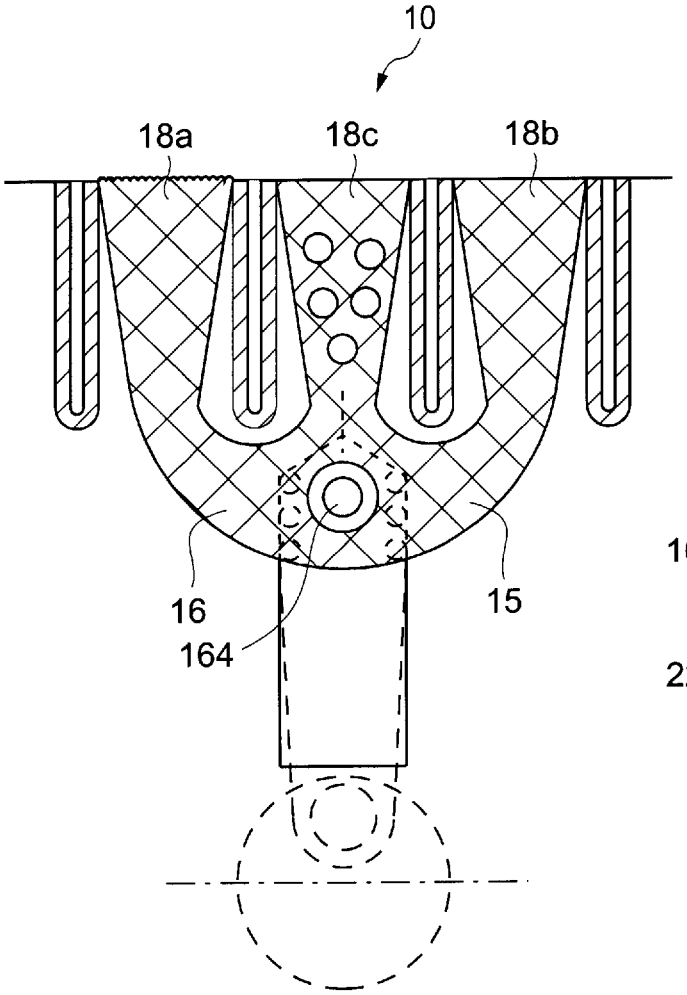
FIGS. 8*a* and 8*b* illustrate a cross sectional view of the present invention showing an alternate configuration of the pistons and the stabilizer.
Figure 8B:
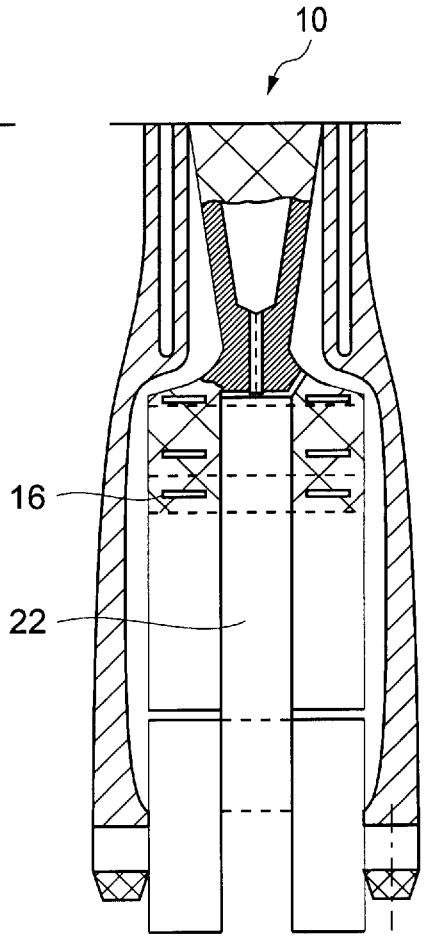

FIGS. 8*a* and 8*b* illustrate an alternate example of the piston assembly 15 implemented as a single piece. Additionally, the portion 164 is shown as a generally circular portion that reciprocates inside a groove (not shown) of the cylinder wall. FIG. 8*b* illustrates a side view of the alternate example shown in FIG. 8*a*.

The crankshafts 14*a* and 14*b*, shown in FIG. 4, may be used to power independent functioning machines, such as separate wheels of an automobile, or may be combined using a gear box (not shown) to produce a single drive shaft having twice the power of the independent crankshafts 14*a* and 14*b*. It should be appreciated that in an automobile setting, the separate crankshafts may be used to drive separate wheels of an automobile. This may eliminate the need for a gear box to transfer the energy from a single drive shaft to the separate wheels. In the particular automobile application, a limited slip differential may be necessary to prevent undue stresses on the engine 10.

While the invention has been particularly shown and described with reference to the preferred embodiments thereof, it will be understood by those skilled in the art that various changes in form and details may be made without departing from the spirit and scope of the invention.

What is claimed is:

1. An internal combustion engine comprising:

an engine block comprising two opposed guide slots on an interior surface;

a cylinder formed in said engine block;

a piston moving in a linear direction perpendicular to the inside of said cylinder in response to energy forces in a respective chamber positioned at one end of said cylinder; and a guide rod portion connected to said piston comprising a guide rod having first and second guide rod ends, wherein each of said guide rod ends engages one of said guide slots in said block, wherein said guide rod portion maintains said linear direction of movement of said piston.

2. The engine according to claim 1, further comprising a connecting arm pivotally connected to said guide rod portion.

3. The engine according to claim 2, wherein said connecting arm further comprises an arcuate taper.

4. The engine according to claim 1, wherein said guide slots are configured parallel to one-another and substantially parallel to said linear direction.

5. The engine according to claim 1, wherein said guide slots are positioned below said cylinder.

6. The engine according to claim 1, wherein said guide rod slots further comprise bearing surfaces.

7. The engine according to claim 1, wherein said guide rod ends further comprise guide rod end bearings.

8. The engine according to claim 1, wherein said piston is conical, wherein a smaller end of said conical piston is connected to said guide rod.

9. The engine according to claim 1, wherein said piston is formed with a pattern of holes to reduce weight, wherein strength is maintained.

10. An internal combustion engine comprising:

means for engaging first and second opposed ends of a guide rod on an interior surface of an engine block;

means for containing energy forces in said engine block;

means for transferring said energy forces in a linear direction perpendicular to the inside of said energy forces containing means; and means for maintaining said linear direction of motion of said transferring means, wherein said guide rod is coupled to said transferring means.

11. A method for facilitating motion in a linear direction of a piston in an internal combustion engine comprising the steps of:

(A) engaging first and second opposed ends of a guide rod on an interior surface of an engine block;

(B) containing energy forces in said engine block;

(C) transferring said energy forces to motion in a linear direction of said piston; and (D) maintaining said linear direction of motion of said piston using said guide rod.

12. The method according to claim 11, wherein said method further comprises the step of:

(E) pivotally connecting a connecting arm to said guide rod portion.

13. The method according to claim 11, wherein step (A) further comprises the sub-step of forming said guide slots parallel to one-another and substantially parallel to said linear direction.

14. The method according to claim 11, wherein said guide slots are engraved.

* * * * *

UNITED STATES PATENT AND TRADEMARK OFFICE

CERTIFICATE OF CORRECTION

PATENT NO. : 6,205,972 B1
DATED : March 27, 2001
INVENTOR(S) : Alfonso Di Stefano It is certified that error appears in the above-identified patent and that said Letters Patent is hereby corrected as shown below:

Title page,
Item [73] Assignee:
delete "Cypress Semiconductor Corp., San Jose, CA (US)".

Signed and Sealed this

Thirtieth Day of October, 2001

*Attest:*

Nicholas P. Godici

NICHOLAS P. GODICI
*Acting Director of the United States Patent and Trademark Office*

*Attesting Officer*